United States Patent [19]

Jahnke

[11] 4,166,151

[45] Aug. 28, 1979

[54] NOVEL CORROSION-INHIBITING ESTER COMPOSITIONS

[75] Inventor: Richard W. Jahnke, Mentor-on-the-Lake, Ohio

[73] Assignee: The Lubrizol Corporation, Wickliffe, Ohio

[21] Appl. No.: 872,697

[22] Filed: Jan. 26, 1978

[51] Int. Cl.[2] ..... C23F 11/12; B32B 15/00

[52] U.S. Cl. ..... 428/457; 106/14.41; 252/8.55 E; 252/396; 260/410.9 R; 422/7; 422/12; 427/435

[58] Field of Search ..... 252/396, 8.55 E; 106/14.41; 260/410.9 R; 422/7, 12; 427/443, 435; 428/457, 467

[56] References Cited

U.S. PATENT DOCUMENTS

| | | | |
|---|---|---|---|
| 3,676,348 | 7/1972 | Unick et al. | 252/54 |
| 4,032,550 | 6/1977 | White et al. | 260/410.9 R |
| 4,065,418 | 12/1977 | Foulks et al. | 260/410.9 R |

OTHER PUBLICATIONS

Lutz et al., "X-Ray Diffraction of Long-Chain Esters", Lipids, May 1967, vol. 2, No. 3, pp. 204–207.

Ethyl Corp. Technical Bulletin, "Linear Primary Alcohols", Ethyl Corporation, 1973.

*Primary Examiner*—Benjamin R. Padgett
*Assistant Examiner*—Irwin Gluck
*Attorney, Agent, or Firm*—James W. Adams, Jr.; William H. Pittman

[57] ABSTRACT

Esters of $C_{10-25}$ aliphatic carboxylic acids (especially oleic acid) and $C_{15-40}$ aliphatic alcohols (especially alcohol mixtures) are useful for protecting metal surfaces against corrosion, especially by acidic vapors. They may be applied in the form of a solution or dispersion in a substantially inert, normally liquid organic diluent such as Stoddard solvent.

22 Claims, No Drawings

NOVEL CORROSION-INHIBITING ESTER COMPOSITIONS

This invention relates to new compositions of matter, solutions or dispersions thereof, methods of protecting a metal workpiece by applying thereto a coating of such compositions, and the workpieces thus protected. More particularly, the compositions of this invention comprise esters of aliphatic carboxylic acids containing from about 10 to about 25 carbon atoms and aliphatic alcohols containing from about 15 to about 40 carbon atoms.

The protection of steel sheeting and similar metal workpieces from corrosion in steel mills and the like is a matter of considerable interest. Protection is especially necessary in areas surrounding pickling operations since in these areas, substantial quantities of acidic vapors (for example, hydrochloric acid) are present and such vapors can cause serious corrosion when they come into contact with metal surfaces.

It has been found advantageous to protect metal surfaces from the corrosive effects of acidic vapors by forming thereon a relatively impervious film, preferably one which is waxy in nature. Such a film may be conveniently applied by forming a solution or dispersion of a waxy material in a relatively volatile diluent, applying the solution or dispersion to the metal surface by known techniques of application, and allowing the diluent to evaporate.

A principal object of the present invention, therefore, is to provide new compositions of matter suitable for protecting metal surfaces against corrosion, especially by acidic gases and vapors.

A further object is to provide a method for protecting metal surfaces, especially those of workpieces in steelmaking plants and the like, from corrosion, especially by acidic vapors.

A further object is to produce protective compositions which may be easily and conveniently applied to metal surfaces.

Other objects will in part be obvious and will in part appear hereinafter.

As previously noted, the compositions of this invention are esters of aliphatic carboxylic acids containing about 10–25 carbon atoms and aliphatic alcohols containing about 15–40 carbon atoms. The acids are generally free from acetylenic unsaturation and include, for example, lauric, myristic, palmitic, stearic, arachidic, oleic, linoleic, linolenic and ricinoleic acids as well as mixtures thereof. Fatty acids containing olefinic unsaturation (e.g., oleic, linoleic, linolenic and ricinoleic) are preferred. Especially preferred are acids in the $C_{14-20}$ range, notably oleic acid and commercially available fatty acid mixtures in which oleic acid is the principal constituent; examples of such mixtures are the tall oil fatty acids sold, for example, by Arizona Chemical Company and Sylvachem Corporation under the respective trade names "Acintol FA-2" and "Sylfat 96".

Suitable alcohols are preferably free from acetylenic unsaturation and usually also from ethylenic unsaturation in more than about 10% by weight thereof. They include the hexadecanols, octadecanols, eicosanols and homologous higher alcohols having both straight and branched chains. Mixtures of such alcohols are useful and are often preferred from the standpoint of commercial availability. Among the useful alcohol mixtures are those described in U.S. Pat. No. 3,676,348, which is incorporated by reference herein for such description. They are defined in that patent as comprising unsubstituted substantially saturated aliphatic monohydric normal alcohols containing about 20–34 carbon atoms per molecule and unsubstituted aliphatic monohydric or dihydric non-normal alcohols containing carbon atoms in the same range and having less than about 5% unsaturated molecules, in combination with hydrocarbons also in about the $C_{20-34}$ range. The alcohol content of these mixtures is at least 1% and preferably about 60–70%, and the weight ratio of normal to non-normal alcohols is preferably between 2:1 and 1:2. The size of the hydrocarbon molecules is immaterial for the purpose of this invention, since they do not form esters in appreciable amounts but merely serve as inert diluent-like substances.

A typical alcohol mixture suitable for preparation of the compositions of this invention is "Epal 20+", which is available from Ethyl Corporation. It has been characterized by the manufacturer as comprising about 33% normal alcohols in the $C_{18-34}$ range, about 34% branched (i.e., non-normal) alcohols in the same carbon atom range, about 12% $C_{24-40}$ paraffinic hydrocarbons, about 18% olefinic hydrocarbons in the same carbon atom range, and about 3% esters.

The esters may be prepared by known methods by reacting the alcohols with the acids or with functional derivatives thereof such as acid halides, anhydrides or lower alkyl esters. The reaction between the acid and the alcohol is usually effected in the presence of an acidic catalyst and a substantially inert diluent, many of which are known to those skilled in the art, at temperatures typically within the range of about 80°–225° C. Approximately equivalent amounts of acid and alcohol are ordinarily used, but an excess of either (typically less than about a 100% excess) may be present without impairing utility for the purposes of this invention. In particular, it is within the scope of the invention to treat an alcohol-hydrocarbon mixture as though it consisted entirely of alcohols, thereby using an excess of acid which may remain in the composition (as evidenced by an acidic neutralization number) without causing harm.

A further embodiment of the present invention is a solution or dispersion of the above-described ester composition in a substantially inert, normally liquid organic diluent. The term "substantially inert" as used herein means that the diluent is inert to chemical or physical change under the conditions in which it is used so as not to materially interfere in an adverse manner with the preparation, storage, blending and/or functioning of the compositions in the context of its intended use. For example, small amounts of the diluent can undergo reaction or degradation without preventing the making and using of the invention as described herein. In other words, such reaction or degradation, while technically discernible, would not be sufficient to deter the practical worker of ordinary skill in the art from making and using the invention for its intended purposes. "Substantially inert" as used herein is, thus, readily understood and appreciated by those of ordinary skill in the art.

Suitable diluents for use in the present invention include, for example, hydrocarbons, alcohols, ethers, esters and the like. The diluents are relatively volatile at ambient and normal storage temperatures, which means that they possess a vapor pressure at such temperatures high enough so that evaporation from a metal surface takes place within a relatively short time (e.g., 4–6 hours). Examples of suitable solvents are volatile naphtha fractions, Stoddard solvent, methanol, ethanol, various lower alkyl ethers, ethyl acetate and the like. Particularly preferred are hydrocarbon fractions such as the naphthas and Stoddard solvent, with the latter being especially desirable.

The solutions or dispersions of this invention normally contain about 5–75 parts by weight, per 100 parts of said solution or dispersion, of the ester composition. As is apparent from the definition thereof, either a solution or dispersion may be formed when the ester and diluent are blended. For example, "Epal 20+" is soluble in Stoddard solvent only to about 10%, so that a composition comprising more than that percentage in combination with Stoddard solvent will be largely a dispersion. Such dispersions are suitable for use to protect metal workpieces as described herein.

The invention also includes metal workpieces having on their surface a protective film comprising the above-described ester composition, and a method of protecting such workpieces against corrosion by coating the same with such composition, usually in the form of the solution or dispersion of this invention from which the diluent is then allowed to evaporate (although the invention includes coating the workpiece with the ester in the absence of diluent). Coating of the workpiece may be effected by any known method such as dipping, brushing, spraying, flow coating or the like and is normally effected at ambient temperatures, e.g., about 20°–35° C. The workpiece may be ferrous metal, aluminum, or any other metal subject to corrosion, but the invention is particularly useful fot the treatment of ferrous metal (e.g., steel) workpieces.

The present invention is illustrated by an example in which an ester is prepared by reaction of 142 parts by weight of "Acintol FA-2" with 280 parts of "Epal 20+" in xylene solution at 188°–190° C., in the presence of p-toluene-sulfonic acid. The xylene is removed by vacuum stripping and the resulting ester has an acid number of 9.5, using phenolphthalein as the indicator. A 60% (by weight) dispersion of this ester in Stoddard solvent is prepared by mixing at 65° C. and is cooled to room temperature. Steel panels are dipped in the dispersion, removed and allowed to hand vertically for 4 hours at room temperature, whereupon the Stoddard solvent evaporates to leave a waxy film of the ester on the panels.

The panels are suspended over a 3.5 N hydrochloric acid solution and are observed periodically. After 4 days, only slight evidence of corrosion is noted, and after 5 days approximately 30% of the panel is coated with a very light stain. A control panel which has not been treated with the composition of this invention is much more seriously corroded.

What is claimed is:

1. A composition comprising esters of aliphatic carboxylic acids containing from about 10 to about 25 carbon atoms and aliphatic alcohol mixtures comprising unsubstituted substantially saturated $C_{20-34}$ aliphatic monohydric normal alcohols and unsubstituted $C_{20-34}$ aliphatic monohydric or dihydric non-normal alcohols having less than about 5% (by weight) unsaturated molecules, said alcohol mixtures additionally containing hydrocarbons in about the $C_{24-40}$ range.

2. A composition according to claim 1 wherein the acid contains olefinic unsaturation and has about 14–20 carbon atoms.

3. A composition according to claim 2 wherein the alcohol mixture contains about 33% (by weight) of said normal alcohols, about 34% of said non-normal alcohols, about 12% paraffinic hydrocarbons and about 18% olefinic hydrocarbons.

4. A composition according to claim 3 wherein the fatty acid is tall oil fatty acid.

5. A solution or dispersion comprising a substantially inert, normally liquid organic diluent which is relatively volatile at ambient and normal storage temperatures and about 5–75 parts by weight, per 100 parts of said solution or dispersion, of a composition according to claim 1.

6. A solution or dispersion according to claim 5 wherein the diluent is a hydrocarbon fraction.

7. A solution or dispersion according to claim 6 wherein the acid contains olefinic unsaturation and has about 14–20 carbon atoms.

8. A solution or dispersion according to claim 7 wherein the alcohol mixture contains about 33% normal alcohols, about 34% branched alcohols, about 12% paraffinic hydrocarbons and about 18% olefinic hydrocarbons.

9. A solution or dispersion according to claim 8 wherein the fatty acid is tall oil fatty acid.

10. A solution or dispersion comprising Stoddard solvent and about 5–75 parts by weight, per 100 parts of said solution or dispersion, of a composition comprising an ester of tall oil fatty acid and a mixture comprising:

about 33% (by weight) unsubstituted substantially saturated aliphatic monohydric $C_{18-34}$ normal alcohols;

about 34% unsubstituted aliphatic monohydric or dihydric $C_{18-34}$ non-normal alcohols having less than about 5% unsaturated molecules;

about 12% $C_{24-40}$ paraffinic hydrocarbons; and about 18% $C_{24-40}$ olefinic hydrocarbons.

11. A metal workpiece having on its surface a protective film comprising a composition according to claim 1.

12. A metal workpiece having on its surface a protective film comprising a composition according to claim 2.

13. A metal workpiece having on its surface a protective film comprising a composition according to claim 3.

14. A metal workpiece having on its surface a protective film comprising a composition according to claim 4.

15. A metal workpiece having on its surface a protective film comprising esters of aliphatic carboxylic acids containing from about 10 to about 25 carbon atoms and aliphatic alcohols containing from about 15 to about 40 carbon atoms.

16. A method of protecting a metal workpiece against corrosion which comprises coating said workpiece with a composition according to claim 1.

17. A method of protecting a metal workpiece against corrosion which comprises coating said workpiece with a solution or dispersion according to claim 5 and allowing the diluent to evaporate.

18. A method of protecting a metal workpiece against corrosion which comprises coating said workpiece with a solution or dispersion according to claim 9 and allowing the diluent to evaporate.

19. A method of protecting a metal workpiece against corrosion which comprises coating said workpiece with a solution or dispersion according to claim 11 and allowing the diluent to evaporate.

20. A method of protecting a metal workpiece against corrosion which comprises coating said workpiece with a solution or dispersion according to claim 9 and allowing the diluent to evaporate.

21. A method of protecting a metal workpiece against corrosion which comprises coating said workpiece with a solution or dispersion according to claim 13 and allowing the diluent to evaporate.

22. A method of protecting a metal workpiece against corrosion which comprises coating said workpiece with a solution or dispersion of one or more esters in a substantially inert, normally liquid organic diluent and allowing the diluent to evaporate;

said esters comprising esters of aliphatic carboxylic acids containing from about 10 to about 25 carbon atoms and aliphatic alcohols containing from about 15 to about 40 carbon atoms;

said diluent being relatively volatile at ambient and normal storage temperatures; and said solution or dispersion comprising about 5–75 parts by weight of said esters per 100 parts of said solution or dispersion.

* * * * *

UNITED STATES PATENT AND TRADEMARK OFFICE

CERTIFICATE OF CORRECTION

PATENT NO. : 4,166,151

DATED : Aug. 28, 1979

INVENTOR(S) : Richard W. Jahnke

It is certified that error appears in the above-identified patent and that said Letters Patent are hereby corrected as shown below:

Column 4, line 63, "9" should read --7--; line 67, "11" should read --8--. Column 5, line 7, "13" should read --10--.

Signed and Sealed this

*Fourth* Day of *December 1979*

[SEAL]

*Attest:*

SIDNEY A. DIAMOND

*Attesting Officer*

*Commissioner of Patents and Trademarks*